US010411396B2

(12) United States Patent
Itani et al.

(10) Patent No.: US 10,411,396 B2
(45) Date of Patent: Sep. 10, 2019

(54) CONNECTOR-EQUIPPED WIRE AND PRODUCTION METHOD FOR CONNECTOR-EQUIPPED WIRE

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Yasushi Itani, Mie (JP); Masaharu Suetani, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/561,144

(22) PCT Filed: Mar. 7, 2016

(86) PCT No.: PCT/JP2016/056923
§ 371 (c)(1),
(2) Date: Sep. 25, 2017

(87) PCT Pub. No.: WO2016/152471
PCT Pub. Date: Sep. 29, 2016

(65) Prior Publication Data

US 2018/0054019 A1 Feb. 22, 2018

(30) Foreign Application Priority Data

Mar. 25, 2015 (JP) ..... 2015-062545

(51) Int. Cl.
*H01B 17/56* (2006.01)
*H01R 13/52* (2006.01)
(Continued)

(52) U.S. Cl.
CPC ..... *H01R 13/5205* (2013.01); *H01R 43/005* (2013.01); *H01R 43/18* (2013.01); *H01R 43/28* (2013.01)

(58) Field of Classification Search
CPC ..... H01R 13/5208; H01R 13/5205; H01R 13/5221; H01R 13/5219; H01R 13/523
(Continued)

(56) References Cited

U.S. PATENT DOCUMENTS 4,921,437 A * 5/1990 Cooper ..... H01R 13/4223 439/275
5,927,725 A * 7/1999 Tabata ..... H01R 13/5205 174/152 G
(Continued)

FOREIGN PATENT DOCUMENTS

JP 7-326403 12/1995
JP 2000-48900 2/2000
(Continued)

OTHER PUBLICATIONS

International Search Report dated May 24, 2016.

*Primary Examiner* — Hien Vu
(74) *Attorney, Agent, or Firm* — Gerald E. Hespos; Michael J. Porco; Matthew T. Hespos

(57) ABSTRACT

A connector-equipped wire includes a terminal, and a wire including a core and an insulation coating provided around the core. The terminal is connected to an end part and is formed with a bulge so that a part of an end part of the insulation coating protrudes radially out. Further, the connector-equipped wire includes a connector housing including a body formed with a cavity into which the wire is to be inserted, and formed with a step on an inner peripheral surface of the cavity of the body. The bulge comes into
(Continued)

contact with the step, and a retainer to be locked to the connector housing with the bulge pressed toward the step.

4 Claims, 3 Drawing Sheets

(51) Int. Cl.
*H01R 43/18* (2006.01)
*H01R 43/00* (2006.01)
*H01R 43/28* (2006.01)

(58) Field of Classification Search
USPC ..... 439/587, 274, 275, 460
See application file for complete search history.

(56) References Cited

U.S. PATENT DOCUMENTS

| | | | | |
|---|---|---|---|---|
| 6,302,733 | B1 | 10/2001 | Sakaguchi et al. | |
| 6,398,585 | B1 * | 6/2002 | Fukuda ..... | H01R 13/5208 439/587 |
| 6,409,541 | B1 * | 6/2002 | Hattori ..... | H01R 13/5205 439/279 |
| 7,029,328 | B1 * | 4/2006 | Mckenzie ..... | H01R 13/5221 439/587 |
| 8,608,508 | B2 * | 12/2013 | Kataoka ..... | H01R 13/5208 439/275 |

FOREIGN PATENT DOCUMENTS

| | | |
|---|---|---|
| JP | 2009-48929 | 3/2009 |
| JP | 2010-92626 | 4/2010 |
| JP | 2015-130265 | 7/2015 |
| JP | 2015-220163 | 12/2015 |

* cited by examiner

CONNECTOR-EQUIPPED WIRE AND PRODUCTION METHOD FOR CONNECTOR-EQUIPPED WIRE

BACKGROUND

Field of the Invention

This invention relates to a technique for waterproofing a connector.

Description of the Related Art

Japanese Unexamined Patent Publication No. 2009-48929 and Japanese Unexamined Patent Publication No. 2010-92626 disclose techniques for waterproofing a connector having a terminal-equipped wire inserted therein.

A waterproof connector described in Japanese Unexamined Patent Publication No. 2009-48929 is configured such that a rubber plug is arranged to be compressible in a front-rear direction between a front stop provided on the inner peripheral surface of a rubber plug mounting hole and a rubber plug pressing member in a connector housing. The connector housing and the rubber plug pressing member are provided with position adjusting means for changing the mounted position of the rubber plug pressing member in the connector housing in the front-rear direction.

An equal diameter portion to be fit closely to the inner periphery of a cavity and a tapered portion gradually reduced in diameter toward a rear end are successively provided toward a rear side on a rear end side of a rubber plug described in Japanese Unexamined Patent Publication No. 2010-92626. When the rubber plug is fit to an entrance side of the cavity, a connection edge of the tapered portion with the equal diameter portion is located flush with or outward of an opening edge of the entrance of the cavity.

Depending on a vehicle, diameters of wires to be mounted need to be increased as a designed current value increases. However, the waterproof connectors described in Japanese Unexamined Patent Publication No. 2009-48929 or Japanese Unexamined Patent Publication No. 2010-92626 require a rubber plug diameter to be increased as a wire diameter is increased. Thus, the connector must be enlarged as the rubber plug is enlarged. Further, operability in mounting the rubber plug is deteriorated due to the enlargement of the rubber plug.

Accordingly, an object of the invention is to provide a technique capable of cutting off water between a connector housing and a wire even without using a rubber plug.

SUMMARY

A connector-equipped wire according to the invention includes a terminal, a wire including a core and an insulation coating provided around the core. The terminal is connected to an end part and is formed with a bulge so that a part of an end part of the insulation coating protrudes radially out. The connector also has a connector housing including a body formed with a cavity into which the wire is to be inserted, and formed with a step on an inner peripheral surface of the cavity of the body so that the bulge contacts the step. The connector further has a retainer to be locked to the connector housing with the bulge pressed toward the step.

An inner peripheral surface of the insulation coating also may protrude outward in the bulge. Thus, the bulge can have a sufficient thickness since the inner peripheral surface of the insulation coating also protrudes out in the bulge.

The insulation coating may be formed of highly heat resistant resin. Accordingly, the insulation coating is unlikely to be deteriorated even at a high temperature since the insulation coating is formed of the highly heat resistant resin. Thus, water cut-off can be achieved more reliably even at a high temperature is the bulge may be formed by creasing an end edge part of the insulation coating. Therefore, the bulge is not likely thin since the bulging portion is formed by creasing an end edge part of the insulation coating. Thus, water cut-off performance can be ensured more stably. Further, a coating stripping operation for the connection of the wire to the terminal can be omitted.

In each of the above described embodiments, the wire, including the core and the insulation coating provided around the core, have the terminal connected to the end part and formed with the bulge so that the part of the end part of the insulation coating protrudes radially outward. Additionally, the connector housing includes the body formed with the cavity into which the wire is to be inserted, and formed with the step on the inner peripheral surface of the cavity of the body. The bulge comes contacts the step, and the retainer is locked to the connector housing with the bulge pressed toward the step. Thus, water cut-off can be achieved between the insulated wire and the connector housing by bringing the bulge of the insulated wire and the step of the connector housing into close contact by the retainer without using a rubber plug.

The invention also relates to production method for a connector-equipped wire. The method may include (a) causing an insulation coating on an end part of a wire including a core and the insulation coating provided around the core to protrude outward to form a bulge by at least one of suction from outside and gas feed into the insulation coating and connecting a terminal to the end part of the wire, (b) inserting the wire into a connector housing, and (c) locking a retainer to the connector housing with the bulge of the wire pressed toward a step of the connector housing by the retainer. The method enables the bulge to be formed easily since the bulge is formed by blowing or vacuuming The production method may include heating a part of the insulation coating until softened in forming the bulge. Thus, the insulation coating easily protrudes and the bulge is formed easily since the part of the insulation coating is heated until softened

DETAILED DESCRIPTION

Figure 1:
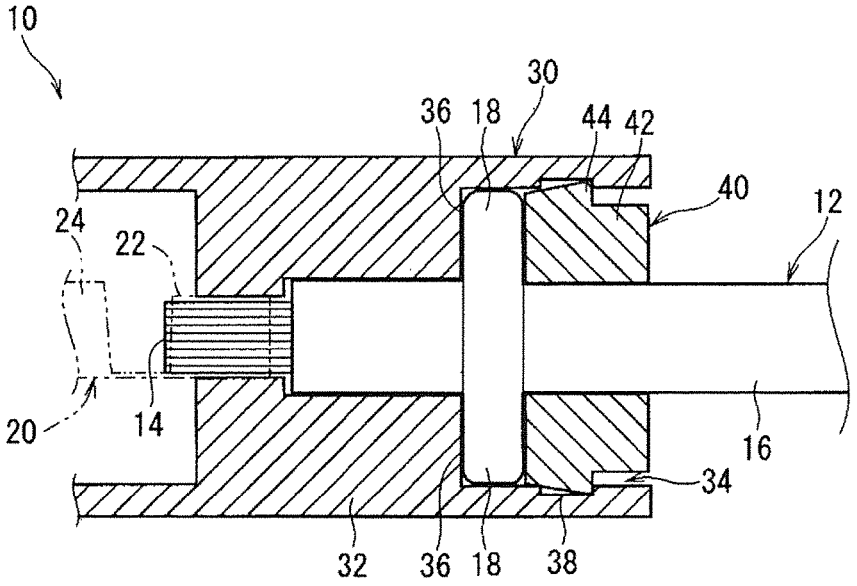
FIG. 1 is a schematic section showing a connector-equipped wire according to an embodiment.
Figure 2:
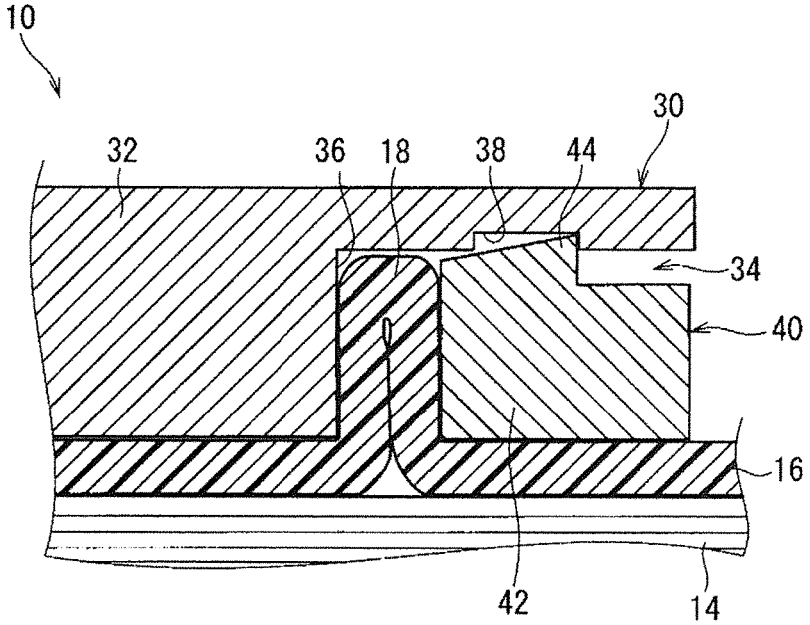
FIG. 2 is a partial enlarged section showing the connector-equipped wire according to the embodiment.

Hereinafter, a connector-equipped wire 10 according to an embodiment is described. FIG. 1 is a schematic section showing the connector-equipped wire 10 according to the embodiment. FIG. 2 is a partial enlarged section showing the connector-equipped wire 10 according to the embodiment. Note that an insulation coating 16 of a wire 12 is not shown in section in FIG. 1, whereas the insulation coating 16 of the wire 12 is shown in section in FIG. 2.

The connector-equipped wire 10 according to the embodiment includes a terminal 20, the wire 12, a connector housing 30 and a retainer 40.

The terminal 20 includes a wire fixing portion 22 and a connecting portion 24. The wire fixing portion 22 is connected to a core exposed part. Here, the wire fixing portion 22 is mounted by being crimped to the wire 12. Of course, a connection method of the wire fixing portion 22 to a core 14 is not limited to this. For example, a wire fixing portion may be connected to the core 14 by joining such as welding.

The connecting portion 24 is a part connected to the wire fixing portion 22. The connecting portion 24 is formed to be connectable to a mating conductor. The connecting portion may be, for example, formed into a flat plate, formed with a through hole penetrating through principal surfaces thereof, and connected to a connection object, for example, by being screwed to the connection object using this through hole. Further, the connecting portion may have, for example, a so-called male terminal shape such as in the form of a pin or tab. Further, the connecting portion may have, for example, a so-called female terminal shape such as in the form of a tube.

The wire 12 includes the core 14 and the insulation coating 16 provided around the core 14. The core 14 is composed of at least one strand made of a conductive material such as copper or aluminum. Here, the core 14 is composed of a plurality of strands. The insulation coating 16 is formed such as by extruding an insulating material around the core 14. Further, the core exposed part where the core 14 is exposed is formed on an end part of the wire 12. The core exposed part is formed such as by stripping the insulation coating 16 on the end part of the wire 12. The wire 12 is used to electrically connect various electrical devices mounted in a vehicle or the like with the terminal 20 connected to the end part and disposed at a target position of the vehicle or the like.

Figure 3:
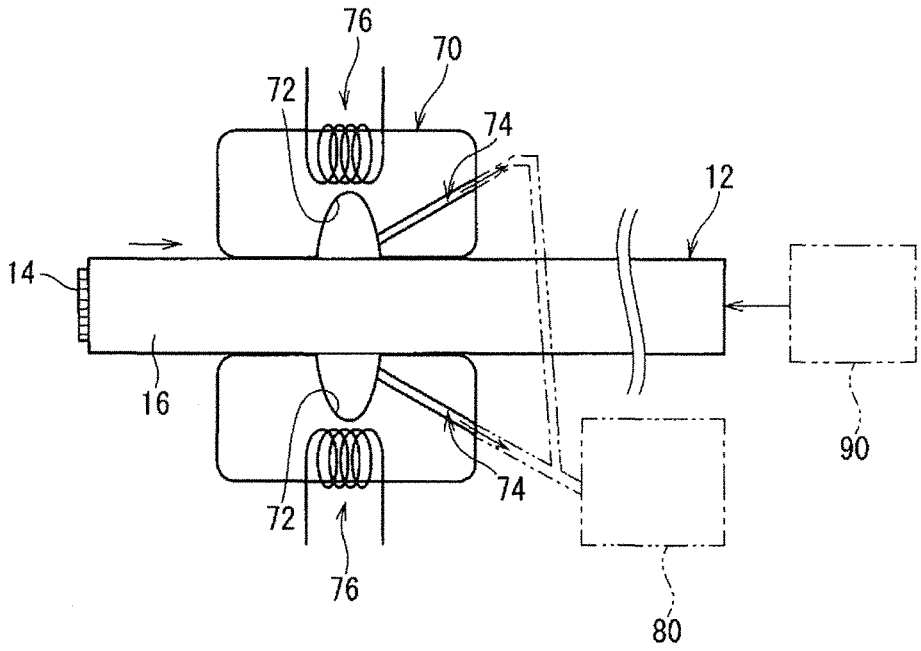
FIG. 3 is a diagram showing a method for forming a bulge.
Figure 4:
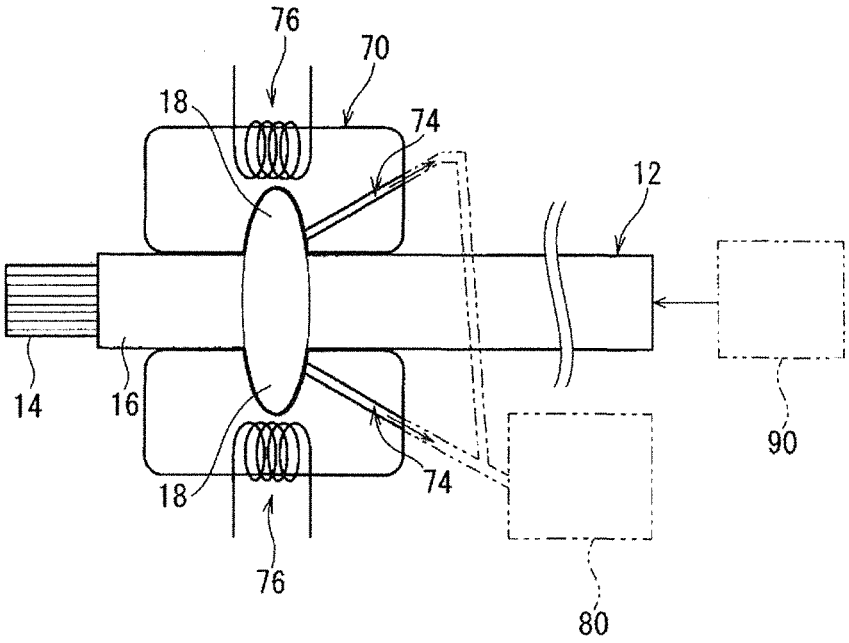
FIG. 4 is a diagram showing the method for forming the bulge.
Figure 5:
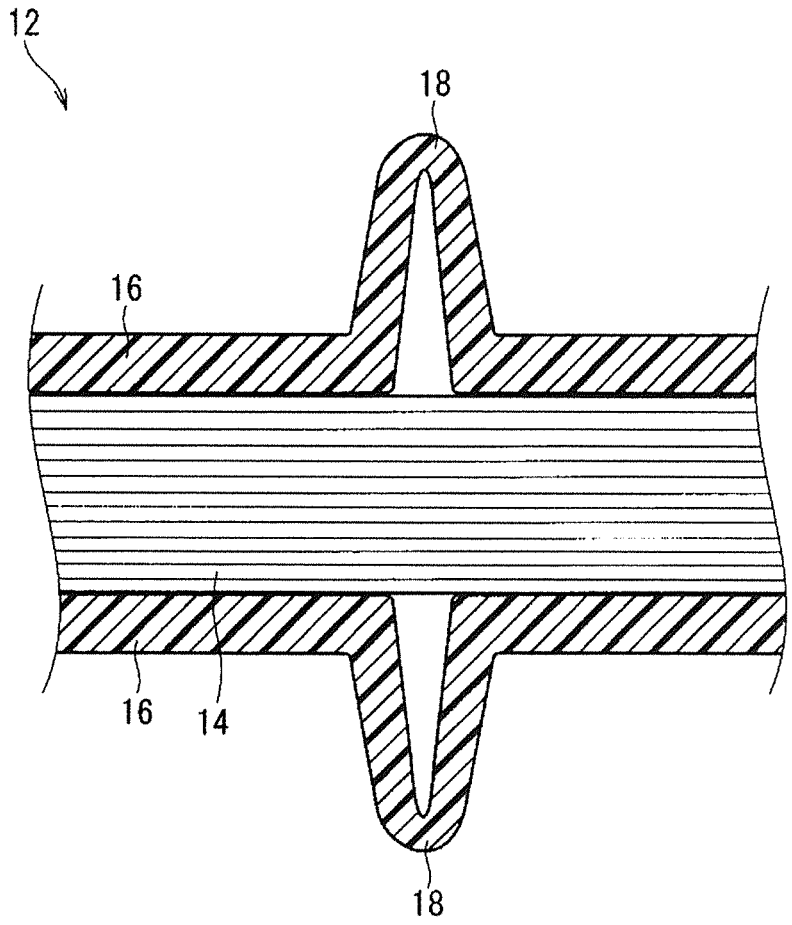
FIG. 5 is a schematic section showing a part of the wire around the bulge.

The wire 12 is formed with a bulge 18 such that a part of an end part of the insulation coating protrudes radially out. The bulge 18 of the wire 12 and a method for forming the bulge 18 are described also with reference to FIGS. 3 to 5. FIGS. 3 and 4 are diagrams showing the method for forming the bulge 18 of the wire 12. FIG. 5 is a schematic section showing a part of the wire 12 around the bulge 18.

The bulge 18 is formed into an annular shape (here, circular annular shape). The bulge 18 is formed by deforming a part of the insulation coating 16 here. More specifically, the bulge 18 is formed by causing the part of the insulation coating 16 to protrude radially outward such that the inner peripheral surface of the insulation coating 16 also protrudes outward.

At this time, a thickness of the insulation coating 16 in the bulge 18 is set to be approximately equal to that of the insulation coating 16 in parts other than the bulge 18. Although described in detail later, this is because the bulge 18 is formed by creasing an end edge part of the insulation coating 16. By setting the thickness of the insulation coating 16 in the bulge 18 to be approximately equal to that of the insulation coating 16 in the parts other than the bulge 18, the bulge 18 is more reliably held in close contact with a step portion 36 of the connector housing 30 as compared to the case where a thickness of an insulation coating in a bulge is smaller than that of the insulation coating in parts other than the bulging portion. More specifically, if the thickness of the insulation coating in the bulge is smaller than that of the insulation coating in parts other than the bulge, the bulge may elongate when the bulging portion is pressed against the step portion 36 by the retainer 40. In contrast, by setting the thickness of the insulation coating 16 in the bulge 18 to be approximately equal to that of the insulation coating 16 in the parts other than the bulge 18, the elongation of the bulge can be suppressed when the bulge 18 is pressed against the step portion 36 by the retainer 40. Of course, the thickness of the insulation coating 16 in the bulge 18 may be larger or smaller than that of the insulation coating 16 in the parts other than the bulge 18.

A projection amount of the bulge 18 in a radial direction of the wire 12 may be set such that the bulge 18 and the step 36 of the connector housing 30 can be annularly held in close contact when the bulge 18 is pressed toward the connector housing 30 by the retainer 40. Here, the projection amount of the bulge 18 in the radial direction of the wire 12 is set to be approximately equal to a height of the step 36 of the connector housing 30.

If the bulge 18 is formed such that the inner surface of the insulation coating 16 also protrudes radially outward, a distance between parts of the inner surface of the bulge 18 facing each other in a longitudinal direction of the wire 12 is preferably as short as possible and, more preferably, these parts of the inner surface are in contact. This enables a deformation amount of the bulge 18 to be suppressed small when the bulge 18 is pressed against the step 36 of the connector housing 30 by the retainer 40, whereby the bulge 18 can be held more reliably in close contact with the step. Here, the distance between the parts of the inner surface of the bulge 18 facing each other in the longitudinal direction of the wire 12 is suppressed to be short and a dimension of the bulge 18 in the longitudinal direction of the wire 12 is set to be about twice the thickness of the insulation coating 16.

The bulge 18 is formed by mounting a mold 70 around the wire 12 and pressing the insulation coating 16 toward the mold 70. Specifically, the mold 70 is formed into a pipe shape through which the wire 12 is insertable (which is mountable around the wire 12), and an intermediate part of the inner peripheral surface thereof is recessed radially outwardly, thereby forming a bulge forming portion 72. That is, the mold 70 can be held in close contact around the wire 12 on both ends, and a clearance (hollow part) is formed between the mold 70 and the wire 12 in the bulge forming portion 72 in the intermediate part with the mold 70 mounted around the wire 12. The inner surface of the bulge forming portion 72 is formed to have a shape corresponding to a desired shape of the bulge 18.

Note that through holes 74 are formed from the inner surface of the bulge forming portion 72 to the outer surface of the mold 70 here. By allowing these through holes 74 to communicate with an ejector 80 or the like, the interior of the bulge forming portion 72 can come close to vacuum with the mold 70 mounted on the wire 12.

Further, the mold 70 is provided with a heating mechanism 76. An electric heating coil or the like can be, for example, thought as the heating mechanism 76. By providing the mold 70 with the heating mechanism 76, the wire 12 can be heated at and around a part where the mold 70 is mounted. By heating the insulation coating 16 to a temperature near a softening point in this way, the insulation coating 16 is easily pressed against the inner surface of the bulge forming portion 72.

To form the bulge 18 using this mold 70, the mold 70 is first mounted around the end part of the wire 12 including a part where the bulge 18 is desired to be formed as shown in FIG. 3. Specifically, the hollow bulge forming portion 72 is located at a part of the insulation coating 16 where the bulge 18 is desired to be formed. Then, the mold 70 is brought into close contact with both sides of the part of the insulation coating 16 where the bulge 18 is desired to be formed. At this time, a part of the insulation coating 16 closer to a leading end side than the bulging portion forming portion 72 may be creased in the hollow bulge forming portion 72 in advance. Further, by weakening a degree of close contact on the side closer to the leading end than the bulge forming portion 72 out of the parts to be held in close contact with the mold 70, it may be set to crease the insulation coating 16 on the leading end in the bulge forming portion 72 at the time of vacuuming and blowing.

After the mold 70 is set around the wire 12, the heating of the heating mechanism 76 is started. After the insulation coating 16 is heated for a predetermined time or to a predetermined temperature, vacuuming and blowing are started. Specifically, the ejector 80 is operated to suck gas in the hollow bulging portion forming portion 72 so that the interior of the hollow bulging portion forming portion 72 comes close to vacuum. Further, compressed air is blown into the insulation coating 16 from the other end part of the wire 12 using a cylinder nozzle 90 or the like. In this way, the part of the insulation coating 16 where the hollow bulge forming portion 72 is located gradually protrudes outwardly and, eventually, is pressed against the inner surface of the bulging portion forming portion 72 as shown in FIG. 4. Thereafter, the insulation coating 16 is cooled such as by natural cooling, and solidified in this state, whereby the insulation coating 16 is formed with the bulge 18.

Note that, such as when the insulation coating 16 is thick, the inner surface of the insulation coating 16 may not protrude outward even if it is attempted to form the bulge 18 by the above method. That is, the outer surface of the insulation coating 16 may partially elongate to protrude outwardly.

Although the bulge 18 has been described to be formed by vacuuming and blowing thus far, the method for forming the bulge is not limited to the one described above. For example, it is also thought to form the bulge only by either one of vacuuming and blowing. Further, it is also thought to form the bulge by solidifying the creased part of the insulation coating 16 by an adhesive or the like with the end part of the insulation coating 16 protruding outward by being pushed toward the other end side.

The insulation coating 16 is formed of highly heat resistant resin. Thus, the bulge 18 is also highly heat resistant. Here, high heat resistance means resistance against a temperature exceeding 150° C. For example, a 180° C. heat resistant silicone resin wire, a 200° C. heat resistant fluororesin wire or the like is thought as the wire including the insulation coating 16 formed of highly heat resistant resin.

The connector housing 30 includes a body 32. The body 32 is formed with a cavity 34 into which the wire 12 is to be inserted. The step 36 with which the bulge 18 comes into contact to be hooked is formed on the inner peripheral surface of the cavity 34 of the body 32. The connector housing 30 is an integrally molded member made of insulating resin. When the wire 12 is inserted into the cavity 34, a clearance is formed between the inner surface of the cavity 34 and the outer surface of the wire 12. To suppress the intrusion of water and the like through this clearance, the bulge 18 is pressed against the step 36 by the retainer 40.

More specifically, a space for connecting the terminal 20 to the mating conductor is present inside the body 32 of the connector housing 30, and the body 32 is formed with the cavity 34 for the insertion of the terminal-equipped wire formed with the bulge 18 toward that space. The step 36 is formed on the inner peripheral surface of the cavity 34, and the bulge 18 comes into contact with a side of the step 36 facing an opening to be hooked. That is, a narrow part is present at an intermediate position between the opening of the cavity 34 and the space for accommodating the terminal 20.

Further, a locked portion 38 to which a lock portion 44 of the retainer 40 is to be hooked is formed on a side of the body 32 of the connector housing 30 closer to the opening than the step 36. The locked portion 38 is formed by recessing a part of the inner peripheral surface of the cavity 34 radially out.

The retainer 40 is locked to the connector housing 30 with the bulge 18 pressed toward the step 36. The retainer 40 is, for example, an integrally molded member made of insulating resin.

Specifically, the retainer 40 includes a body 42 and the lock portion 44. The body 42 is formed into an annular shape (circular annular shape, here) so as to be able to press the annular bulge 18 over the entire circumference. Further, the body 42 is formed with an insertion hole so that the wire 12 is insertable therethrough. The lock portion 44 projects around the body 42. Here, the lock portion 44 is formed to project gradually more outward from a leading end side toward a rear end side of the body 42 along a center axis direction of the insertion hole. The lock portion 44 is formed to be hooked and locked to the locked portion 38 with the retainer 40 pushed to a predetermined position in the cavity 34 through the opening of the connector housing 30.

By the retainer 40 pressing the bulge 18 toward the step 36, a part of the connector housing 30 closer to the leading end than the step 36 is sealed in a watertight manner. More specifically, by the retainer 40 pressing the bulge 18 toward the step portion 36, a surface of the bulge 18 facing toward the leading end side in the longitudinal direction of the wire 12 and a surface of the step portion 36 facing toward the opening are held in close contact. At this time, the bulge 18 and the retainer 40 are annular and a part where the bulge 18 and the step 36 are held in close contact has a closed annular shape. In this way, the part of the connector housing 30 closer to the leading end side than the step 36 held in close contact with the bulge 18 when viewed from the opening side through which the wire 12 is inserted is sealed.

Note that it is sufficient that the retainer 40 is lockable to the connector housing 30, and the retainer 40 needs not be held in close contact around the wire 12. Further, the retainer may have an annular shape by uniting halved two members. In this case, the wire 12 needs not be inserted through the insertion hole and the mountability of the retainer can be improved.

According to the connector-equipped wire 10 according to the embodiment, the bulge 18 is formed by causing the part of the end part of the insulation coating 16 to protrude radially outward, the step 36 with which the bulge 18 comes into contact is formed on the inner peripheral surface of the cavity 34 of the body 32 of the connector housing 30, and the retainer 40 is locked to the connector housing 30 with the bulge 18 pressed toward the step 36. Thus, water cut-off can be achieved between the connector housing 30 and the wire 12 by holding the bulge 18 of the insulated wire 12 and the step 36 of the connector housing 30 in close contact by the retainer 40. In this way, water cut-off can be achieved between the connector housing 30 and the wire 12 even without using a rubber plug. At this time, since the bulge 18 is formed by causing the part of the end part of the insulation coating 16 to protrude radially out, sealing can be provided by the same material as the insulation coating 16.

Further, since the inner peripheral surface of the insulation coating 16 also protrudes outward in the bulge 18, the bulge 18 can have a sufficient thickness. Further, the bulge 18 easily is caused to protrude out a large distance.

Further, since the insulation coating 16 is formed of highly heat resistant resin, the insulation coating 16 is unlikely to be deteriorated even at a high temperature. Thus, water cut-off can be more reliably achieved even at a high temperature. Particularly, in the case of cutting off water using a rubber plug, rubber is normally easily deteriorated at a high temperature. In contrast, since the part of the insulation coating 16 made of highly heat resistant resin is formed into the bulge 18 in this embodiment, the bulging portion 18 is unlikely to be deteriorated even at a high temperature. Further, in the case of using silicone resin as the highly heat resistant resin, the rubber plug may bite into the insulation coating 16 since the silicone resin is normally less rigid than rubber. Since this biting amount is difficult to predict, the design of the rubber plug has been difficult in the case of employing silicone resin as the material of the insulation coating 16. In contrast, since the rubber plug is not used in this embodiment, the rubber plug does not bite into the insulation coating 16.

Further, since the bulge 18 is formed by creasing the end edge part of the insulation coating 16, it can be suppressed that the bulge 18 becomes thin, whereby more stable water cut-off performance can be ensured. Further, a coating stripping operation performed to connect the wire 12 to the terminal 20 can be omitted.

Note that, in the case of sealing using a rubber plug, sealability is required at two positions, i.e. between the rubber plug and the wire 12 and between the rubber plug and the connector housing. Further, at this time, since a direction in which the rubber plug and the wire 12 are held in close contact and a direction in which the rubber plug and the connector housing are held in close contact are perpendicular to the longitudinal direction of the wire 12, a displacement of the wire 12 easily affects sealability. In contrast, since it is sufficient to provide sealing only at one position between the bulge 18 and the connector housing 30 in this embodiment, sealability is easily ensured and maintained. Further, since a direction in which the bulge 18 and the connector housing 30 are held in close contact is parallel to the longitudinal direction of the wire 12, a displacement of the wire 12 is unlikely to affect sealability.

Further, in the case of sealing using the rubber plug, an inner diameter and an outer diameter need to be specified to mount the rubber plug on the wire 12 and compress the rubber plug. Thus, design has been cumbersome. Further, since high precision is required for design, the processing cost of the rubber plug may increase. In contrast, since it is sufficient to specify only an outer diameter of the bulge 18 such that the bulge 18 and the step 36 can be held in close contact in a closed annular manner in this embodiment, design is easy. Further, since high precision is not required for design, the bulge 18 is formed easily.

Further, in the case of sealing using the rubber plug, an operation of widening and mounting the rubber plug on the wire 12 and an operation of compressing and accommodating the rubber plug into the connector housing 30 are necessary. Thus, assembling workability has been poor. In contrast, in this embodiment, it is sufficient to push the retainer 40 into the cavity 34 after the wire 12 is inserted into the cavity 34. Thus, assembling workability can be improved.

Although this invention has been described in detail above, the above description is illustrative in all aspects and this invention is not limited to that. It should be understood that unillustrated numerous modifications can be made without departing from the scope of this invention.

LIST OF REFERENCE SIGNS

10 connector-equipped wire
12 wire
14 core
16 insulation coating
18 bulging portion
20 terminal
30 connector housing
32 body portion
34 cavity
36 step portion
40 retainer

The invention claimed is:

1. An electrical connector-equipped wire, comprising:

a terminal;

a wire including a core and an insulation coating provided circumferentially around the core, the insulation coating having opposed inner and outer surfaces, an end part of the wire connected to the terminal, a portion of the insulation coating extending from the inner surface to the outer surface projecting radially outward from the core to define a bulge having a diameter greater than a diameter of the wire at positions spaced axially from the bulge;

a connector housing including a body formed with a cavity, the wire accommodated in the cavity, a step formed on an inner peripheral surface of the cavity of the body, the bulge coming into contact with the step; and a retainer locked to the connector housing with the bulge pressed toward the step.

2. The electrical connector-equipped wire of claim 1, wherein the insulation coating is formed of highly heat resistant resin.

3. The electrical connector-equipped wire of claim 1, wherein the bulge is formed by separating the portion of the insulation coating extending from the inner surface to the outer surface from the core, and pressing sections of the inner surface towards each other to define a crease.

4. The electrical connector-equipped wire of claim 1, wherein a thickness of the coating between the inner and outer surfaces at the bulge is equal to a thickness of the coating between the inner and outer surfaces at portions of the wire axially spaced from the bulge.

* * * * *